US010184693B2

(12) United States Patent
Xu et al.

(10) Patent No.: US 10,184,693 B2
(45) Date of Patent: Jan. 22, 2019

(54) GM CRYOCOOLER

(71) Applicant: SUMITOMO HEAVY INDUSTRIES, LTD., Tokyo (JP)

(72) Inventors: Mingyao Xu, Nishitokyo (JP); Takaaki Morie, Yokosuka (JP); Qian Bao, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 120 days.

(21) Appl. No.: 15/298,303

(22) Filed: Oct. 20, 2016

(65) Prior Publication Data

US 2017/0115036 A1 Apr. 27, 2017

(30) Foreign Application Priority Data

Oct. 23, 2015 (JP) ..... 2015-208614
Jun. 10, 2016 (JP) ..... 2016-116329

(51) Int. Cl.
*F25B 9/14* (2006.01)
*F25B 9/10* (2006.01)

(52) U.S. Cl.
CPC ..... *F25B 9/14* (2013.01); *F25B 9/10* (2013.01); *F25B 2309/001* (2013.01)

(58) Field of Classification Search
CPC ..... F25B 9/10; F25B 9/14; F02G 1/044
See application file for complete search history.

(56) References Cited

U.S. PATENT DOCUMENTS 3,552,120 A * 1/1971 Beale ..... F02G 1/0435 60/525
9,366,459 B2 6/2016 Morie
2013/0219923 A1* 8/2013 Mizuno ..... F25B 9/00 62/6
2014/0338367 A1* 11/2014 Morie ..... F25B 9/14 62/6

FOREIGN PATENT DOCUMENTS

JP H05-312426 11/1993
JP 2014-214946 11/2014

OTHER PUBLICATIONS

JP1055312426 Translation.*

* cited by examiner

*Primary Examiner* — Brian M King
(74) *Attorney, Agent, or Firm* — HEA Law PLLC

(57) ABSTRACT

A GM cryocooler is furnished with: a first cold head including a first displacer and a first cylinder; a second cold head including a second displacer and a second cylinder and being disposed opposing the first cold head; a common drive mechanism for driving axial reciprocation of the first displacer and the second displacer; and a working gas circuit for generating between the first cold head and the second cold head a pressure differential that assists the common drive mechanism.

12 Claims, 7 Drawing Sheets

GM CRYOCOOLER

INCORPORATION BY REFERENCE

Priority is claimed to Japanese Patent Application No. 2015-208614, filed Oct. 23, 2015, and Japanese Patent Application No. 2016-116329, filed Jun. 10, 2016, the entire content of each of which is incorporated herein by reference.

BACKGROUND

Technical Field

The present invention in particular embodiments relates to Gifford-McMahon (GM) cryocoolers.

Description of Related Art

GM cryocoolers, which are typifying examples of cryogenic refrigerators, generate extremely low temperatures using the GM cycle. That means that GM cryocoolers are configured so as to appropriately synchronize periodic pressure fluctuations in the expansion space—deriving from intake of the working gas into, its adiabatic expansion in, and its exhausting from, the expansions space—with periodic variation in volume of the expansion space due to the reciprocating movement of the displacer.

SUMMARY

One embodiment of the present invention affords a GM cryocooler including: a first cold head including an axially reciprocatory first displacer, and a first cylinder between the first displacer and which a first gas chamber is formed; a second cold head including a second displacer disposed coaxially with respect to the first displacer and axially reciprocatory unitarily with the first displacer, and a second cylinder between the second displacer and which a second gas chamber is formed, and disposed opposing the first cold head; a common drive mechanism connected to the first displacer and the second displacer such as to drive axial reciprocation of the first displacer and the second displacer; and a working gas circuit connected to the first cold head and the second cold head such as to generate between the first gas chamber and the second gas chamber a pressure differential assisting the common drive mechanism.

Another embodiment of the present invention affords a GM cryocooler including; a first cold head including an axially reciprocatory first displacer, and a first cylinder between the first displacer and which a first gas chamber is formed; and a second cold head including a second displacer disposed coaxially with respect to the first displacer and axially reciprocatory unitarily with the first displacer, and a second cylinder between the second displacer and which a second gas chamber is formed, and disposed opposing the first cold head.

DETAILED DESCRIPTION

Figure 1:
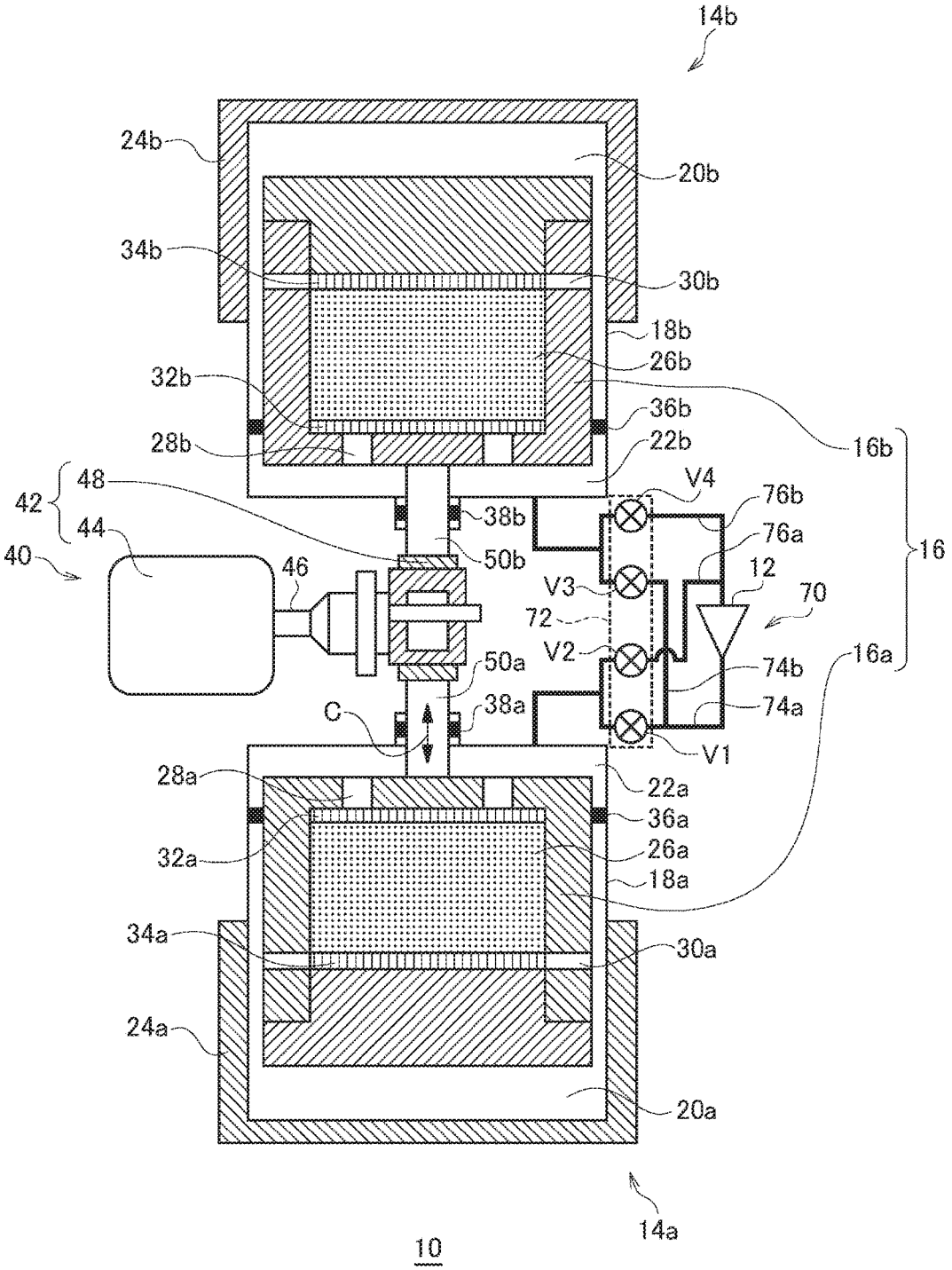
FIG. 1 is a sectional view schematically showing a GM cryocooler according an embodiment of the present invention.

A general basic configuration of a GM cryocooler includes one compressor and one expander (that is, combination between one displacer and a drive portion thereof). As a configuration example derived from this basic configuration, a cryocooler is suggested which includes two displacers which are disposed for one displacer drive portion in parallel and in which intake operations to expansion spaces corresponding to the two displacers are alternately performed. The alternate intake operations of two expanders decrease the pressure fluctuation in a compressor, and improve the efficiency of the compressor. Accordingly, this contributes to improvement in the efficiency of the cryocooler.

However, in order to drive two displacers by one drive portion, a relatively large drive portion which generates a corresponding drive torque is required. In addition, an area of floor for installation of the cryocooler is liable to be increased due to the parallel disposition of the two expanders.

In a GM cryocooler having a plurality of displacers, it is desirable to realize improvement in the efficiency of a compressor while decreasing a drive torque of the displacers.

In addition, arbitrary combinations of the above-described components, or components or expression of the present invention may be replaced by each other in methods, devices, systems, or the like, and these replacements are also included in aspects of the present invention.

According to the present invention, in a GM cryocooler having a plurality of displacers, it is possible to realize improvement in the efficiency of a compressor while decreasing drive torque of the displacers.

Hereinafter, embodiments of the present invention will be described in detail with reference to the drawings. In addition, in descriptions, the same reference numerals are assigned to the same elements, and overlapping descriptions thereof are appropriately omitted. Moreover, configurations described below are exemplified, and do not limit the scope of the present invention.

Figure 2:
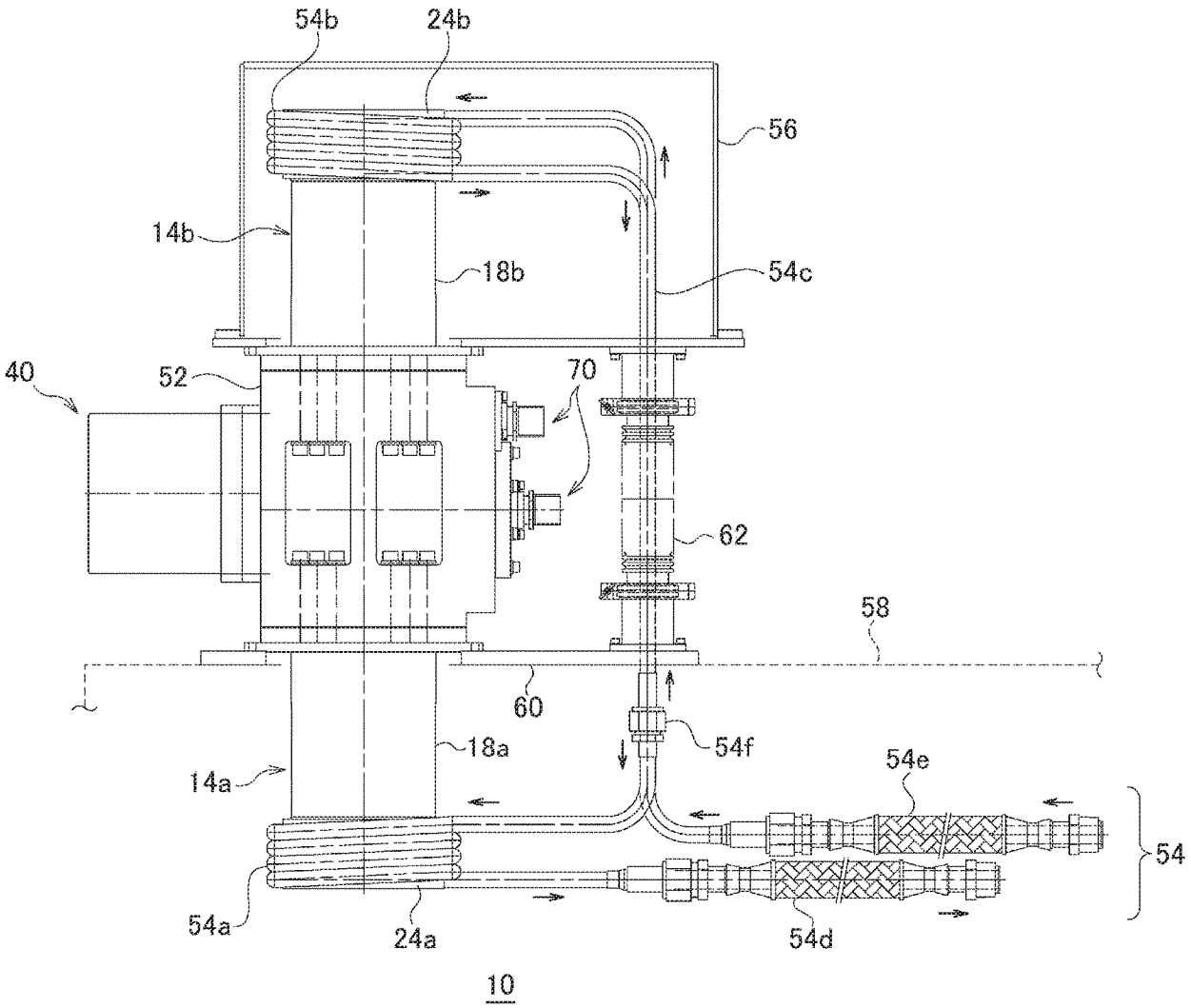
FIG. 2 is an outline view schematically showing the GM cryocooler shown in FIG. 1.
Figure 3:
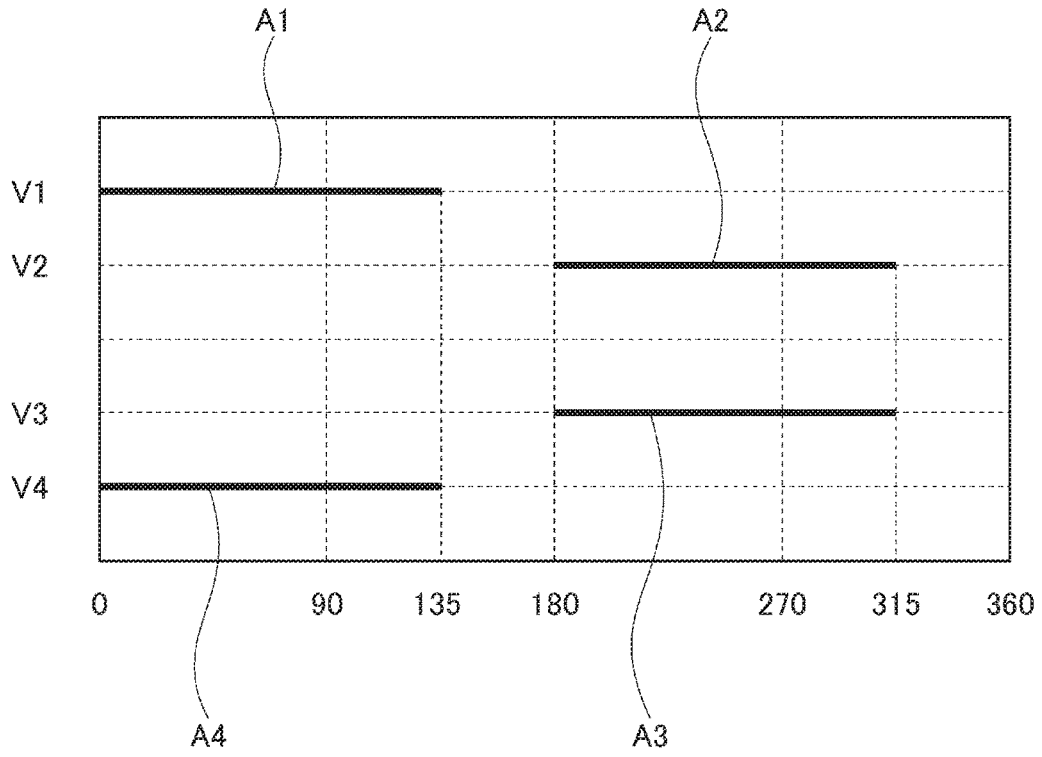
FIG. 3 is a view showing an example of an operation of the GM cryocooler shown in FIG. 1.

FIG. 1 is a sectional view schematically showing a GM cryocooler 10 according to an embodiment of the present invention. FIG. 2 is an outline view schematically showing the GM cryocooler 10 shown in FIG. 1. FIG. 3 is a view showing an example of the operation of the GM cryocooler 10 shown in FIG. 1.

The GM cryocooler 10 includes a compressor 12 which compresses a working gas (for example, helium gas), and a plurality of cold heads which are cooled by adiabatic expansion of the working gas. The cold head is referred to as an expander. As described in detail below, the compressor 12 supplies a high-pressure working gas to the cold heads. A regenerator which pre-cools the working gas is provided in the cold head. The pre-cooled working gas is cooled by expansion in the cold head again. The working gas is recovered to the compressor 12 through the regenerator. When the working gas passes through the regenerator, the regenerator is cooled. The compressor 12 compresses the recovered working gas, and supplies the compressed working gas to the expander again.

The GM cryocooler 10 includes a first cold head 14*a* and a second cold head 14*b* which are disposed so as to face each other. In addition, the GM cryocooler 10 includes a common drive mechanism 40 for the first cold head 14*a* and the second cold head 14*b*. The first cold head 14*a* is disposed on one side with respect to the common drive mechanism 40, and the second cold head 14*b* is disposed on the other side with respect to the common drive mechanism 40. In addition, the GM cryocooler 10 includes a working gas circuit 70 which connects the compressor 12 to the first cold head 14*a* and the second cold head 14*b*.

The first cold head 14*a* is a single staged cold head. The first cold head 14*a* includes a first displacer 16*a* which can axially reciprocate, and a first cylinder 18*a* which accommodates the first displacer 16*a*. The axial reciprocation of the first displacer 16*a* is guided by the first cylinder 18*a*. In general, each of the first displacer 16*a* and the first cylinder 18*a* is a cylindrical member which axially extends, and the inner diameter of the first cylinder 18*a* is slightly greater than the outer diameter of the first displacer 16*a*. Here, an axial direction is an upward-downward direction in FIG. 1 (arrow C).

A first expansion chamber 20*a* is formed between the first displacer 16*a* and the first cylinder 18*a* on one end in the axial direction, and a first room-temperature chamber 22*a* is formed between the first displacer 16*a* and the first cylinder 18*a* on the other end in the axial direction. The first room-temperature chamber 22*a* is positioned near the common drive mechanism 40, and the first expansion chamber 20*a* is positioned far from the common drive mechanism 40. This means that the first room-temperature chamber 22*a* is formed on a proximal end of the first cold head 14*a* and the first expansion chamber 20*a* is formed on a distal end of the first cold head 14*a*. A first cooling stage 24*a*, which is fixed to the first cylinder 18*a* so as to enclose the first expansion chamber 20*a*, is provided on the distal end of the first cold head 14*a*.

When the first displacer 16*a* axially moves, the first expansion chamber 20*a* and the first room-temperature chamber 22*a* complementarily increase and decrease the volume. That is, when the first displacer 16*a* moves upward, the first expansion chamber 20*a* is widened, and the first room-temperature chamber 22*a* is narrowed, and vice versa.

The first displacer 16*a* includes a first regenerator 26*a* which is built therein. The first displacer 16*a* includes a first inlet flow path 28*a*, which allows the first regenerator 26*a* to communicate with the first room-temperature chamber 22*a*, on the upper lid portion of the first displacer 16*a*. In addition, the first displacer 16*a* includes a first outlet flow path 30*a*, which allows the first regenerator 26*a* to communicate with the first expansion chamber 20*a*, on the tubular portion of the first displacer 16*a*. Alternatively, the first outlet flow path 30*a* may be provided on the lower lid portion of the first displacer 16*a*. Moreover, the first displacer 16*a* includes a first inlet flow-straightener 32*a* which is in inner-contact with the upper lid portion, and a first outlet flow-straightener 34*a* which is in inner-contact with the lower lid portion. The first regenerator 26*a* is interposed between the pair of flow-straighteners.

The first cold head 14*a* includes a first seal portion 36*a* which blocks a clearance formed between the first cylinder 18*a* and the first displacer 16*a*. For example, the first seal portion 36*a* is a slipper seal, and is mounted on the tubular portion or the upper lid portion of the first displacer 16*a*.

In this way, the first seal portion 36*a* is positioned near the common drive mechanism 40, and the first outlet flow path 30*a* is away from the common drive mechanism 40 and is positioned near the first cooling stage 24*a*. In other words, the first seal portion 36*a* is attached to a proximal portion of the first displacer 16*a*, and the above-described first outlet flow path 30*a* is formed in a distal portion of the first displacer 16*a*.

The working gas flows from the first room-temperature chamber 22*a* into the first regenerator 26*a* through the first inlet flow path 28*a*. More specifically, the working gas flows from the first inlet flow path 28*a* into the first regenerator 26*a* through the first inlet flow-straightener 32*a*. The working gas flows from the first regenerator 26*a* into the first expansion chamber 20*a* via the first outlet flow-straightener 34*a* and the first outlet flow path 30*a*. The working gas goes through a reverse pathway with respect to the above-described pathway when the working gas is returned from the first expansion chamber 20*a* to the first room-temperature chamber 22*a*. That is, the working gas is returned from the first expansion chamber 20*a* to the first room-temperature chamber 22*a* through the first outlet flow path 30*a*, the first regenerator 26*a*, and the first inlet flow path 28*a*. The working gas, which bypasses the first regenerator 26*a* and flows into the clearance, is interrupted by the first seal portion 36*a*.

As described above, the second cold head 14*b* is disposed on the side opposite to the first cold head 14*a* with respect to the common drive mechanism 40. Except for this, the configuration of the second cold head 14*b* is similar to that of the first cold head 14*a*. Accordingly, similarly to the first cold head 14*a*, the second cold head 14*b* is a single staged cold head, and has the shape and size similar to those of the first cold head 14*a*.

The second cold head 14*b* includes a second displacer 16*b* which is coaxially disposed with respect to the first displacer 16*a* and is able to axially reciprocate integrally with the first displacer 16*a*, and a second cylinder 18*b* which accommodates the second displacer 16*b*. The axial reciprocation of the second displacer 16*b* is guided by the second cylinder 18*b*. In general, each of the second displacer 16*b* and the second cylinder 18*b* is a cylindrical member which axially extends, and the inner diameter of the second cylinder 18*b* is slightly greater than the outer diameter of the second displacer 16*b*.

A second expansion chamber 20*b* is formed between the second displacer 16*b* and the second cylinder 18*b* on one end in the axial direction, and a second room-temperature chamber 22*b* is formed between the second displacer 16*b* and the second cylinder 18*b* on the other end in the axial direction. The second room-temperature chamber 22*b* is positioned near the common drive mechanism 40, and the second expansion chamber 20*b* is positioned far from the common drive mechanism 40. This means that the second room-temperature chamber 22*b* is formed on a proximal end of the second cold head 14*b* and the second expansion chamber 20*b* is formed on a distal end of the second cold head 14*b*. A second cooling stage 24*b*, which is fixed to the second cylinder 18*b* so as to enclose the second expansion chamber 20*b*, is provided on the distal end of the second cold head 14*b*.

When the second displacer 16*b* axially moves, the second expansion chamber 20*b* and the second room-temperature chamber 22*b* complementarily increase and decrease the volume. That is, when the second displacer 16*b* moves upward, the second expansion chamber 20*b* is widened, and the second room-temperature chamber 22*b* is narrowed, and vice versa.

The second displacer 16*b* includes a second regenerator 26*b* which is built therein. The second displacer 16*b* includes a second inlet flow path 28*b*, which allows the second regenerator 26*b* to communicate with the second room-temperature chamber 22*b*, on the upper lid portion of the second displacer 16*b*. In addition, the second displacer 16*b* includes a second outlet flow path 30*b*, which allows the second regenerator 26*b* to communicate with the second expansion chamber 20*b*, on the tubular portion of the second displacer 16*b*. Alternatively, the second outlet flow path 30*b* may be provided on the lower lid portion of the second displacer 16*b*. Moreover, the second displacer 16*b* includes a second inlet flow-straightener 32*b* which is in inner-contact with the upper lid portion, and a second outlet flow-straightener 34*b* which is in inner-contact with the lower lid portion. The second regenerator 26*b* is interposed between the pair of flow-straighteners.

The second cold head 14*b* includes a second seal portion 36*b* which blocks a clearance formed between the second cylinder 18*b* and the second displacer 16*b*. For example, the second seal portion 36*b* is a slipper seal, and is mounted on the tubular portion or the upper lid portion of the second displacer 16*b*.

In this way, the second seal portion 36*b* is positioned near the common drive mechanism 40, and the second outlet flow path 30*b* is away from the common drive mechanism 40 and is positioned near the second cooling stage 24*b*. In other words, the second seal portion 36*b* is attached to a proximal portion of the second displacer 16*b*, and the above-described second outlet flow path 30*b* is formed in the distal portion of the second displacer 16*b*.

The working gas flows from the second room-temperature chamber 22*b* into the second regenerator 26*b* through the second inlet flow path 28*b*. More specifically, the working gas flows from the second inlet flow path 28*b* into the second regenerator 26*b* through the second inlet flow-straightener 32*b*. The working gas flows from the second regenerator 26*b* into the second expansion chamber 20*b* via the second outlet flow-straightener 34*b* and the second outlet flow path 30*b*. The working gas goes through a reverse pathway with respect to the above-described pathway when the working gas is returned from the second expansion chamber 20*b* to the second room-temperature chamber 22*b*. That is, the working gas is returned from the second expansion chamber 20*b* to the second room-temperature chamber 22*b* through the second outlet flow path 30*b*, the second regenerator 26*b*, and the second inlet flow path 28*b*. The working gas, which bypasses the second regenerator 26*b* and flows into the clearance, is interrupted by the second seal portion 36*b*.

The GM cryocooler 10 is installed in the shown direction in the use site thereof. That is, the first cold head 14*a* is disposed downward in the vertical direction, the second cold head 14*b* is disposed upward in the vertical direction, and thus, the GM cryocooler 10 is installed in a longitudinal direction. The second cold head 14*b* is installed with a posture inverted to that of the first cold head 14*a*. The second expansion chamber 20*b* is disposed upward in the vertical direction in the second cold head 14*b* while the first expansion chamber 20*a* is disposed downward in the vertical direction in the first cold head 14*a*. Alternatively, the GM cryocooler 10 may be installed in a horizontal direction or in other directions.

The common drive mechanism 40 includes a reciprocation drive source 42 which drives the axial reciprocation of the first displacer 16*a* and the second displacer 16*b*. The reciprocation drive source 42 includes a rotation drive source 44 (for example, motor) having a rotation output shaft 46, and a Scotch yoke 48 which is connected to the rotation output shaft 46 so as to convert the rotation of the rotation output shaft 46 into axial reciprocation.

The common drive mechanism 40 includes a first connection rod 50*a* and a second connection rod 50*b*. The first connection rod 50*a* axially extends from the reciprocation drive source 42 and connects the reciprocation drive source 42 to the first displacer 16*a*. The second connection rod 50*b* axially extends from the reciprocation drive source 42 on the side opposite to the first connection rod 50*a* and connects the reciprocation drive source 42 to the second displacer 16*b*. The first displacer 16*a*, the first connection rod 50*a*, the second connection rod 50*b*, and the second displacer 16*b* are coaxially disposed with respect to each other.

More specifically, the first connection rod 50*a* axially extends from the Scotch yoke 48 to the first displacer 16*a* and connects the Scotch yoke 48 to the first displacer 16*a*. The first connection rod 50*a* rigidly connects the proximal portion of the first displacer 16*a* to the Scotch yoke 48. The first connection rod 50*a* is supported by a first bearing portion 38*a* so as to be movable in the axial direction. The first bearing portion 38*a* is disposed between the Scotch yoke 48 and the first displacer 16*a*.

The second connection rod 50*b* axially extends from the Scotch yoke 48 to the second displacer 16*b* and connects the Scotch yoke 48 to the second displacer 16*b*. The second connection rod 50*b* rigidly connects the proximal portion of the second displacer 16*b* to the Scotch yoke 48. The second connection rod 50*b* is supported by a second bearing portion 38*b* so as to be movable in the axial direction. The second bearing portion 38*b* is disposed between the Scotch yoke 48 and the second displacer 16*b*.

As shown in FIG. 2, the common drive mechanism 40 includes a drive mechanism housing 52. The first cylinder 18*a* is fixed to one side of the drive mechanism housing 52, and the second cylinder 18*b* is fixed to the other side of the drive mechanism housing 52. The second cylinder 18*b* is coaxially disposed with respect to the first cylinder 18*a*. Moreover, for simplification, in FIG. 2, the compressor 12 is not shown.

The reciprocation drive source 42 and the Scotch yoke 48 shown in FIG. 1 are accommodated in the drive mechanism housing 52. Similarly to the Scotch yoke 48, the proximal ends of the first connection rod 50*a* and the second connection rod 50*b* are accommodated in the drive mechanism housing 52. Similarly to the first displacer 16*a* and the second displacer 16*b*, the distal ends of the first connection rod 50*a* and the second connection rod 50*b* are respectively accommodated in the first cylinder 18*a* and the second cylinder 18*b*. The first bearing portion 38*a* is disposed at the boundary between the first cylinder 18*a* and the drive mechanism housing 52 and in the vicinity thereof. The second bearing portion 38*b* is disposed at the boundary between the second cylinder 18*b* and the drive mechanism housing 52 and in the vicinity thereof. The first bearing portion 38*a* and the second bearing portion 38*b* are configured as seal portions which hold airtightness of the first cylinder 18*a* and the second cylinder 18*b* with respect to the drive mechanism housing 52.

In this way, the common drive mechanism 40 is connected to the first displacer 16*a* and the second displacer 16*b* so as to drive the axial reciprocation of the first displacer 16*a* and the second displacer 16*b*. The first displacer 16*a* and the second displacer 16*b* configure a single displacer connector 16 which is fixedly connected to each other. A relative position of the second displacer 16*b* with respect to the first displacer 16*a* is not changed during the axial reciprocation of the first displacer 16*a* and the second displacer 16*b*.

Accordingly, the axial reciprocation of the first displacer 16*a* and the axial reciprocation of the second displacer 16*b* have phases opposite to each other. When the first displacer 16*a* is positioned at the top dead center (that is, the dead center on the proximal end side), the second displacer 16*b* is positioned at the bottom dead portion (that is, the dead center on the distal end side). When the first displacer 16*a* moves from the top dead center to the bottom dead center (that is, when the first displacer 16*a* moves from the proximal end of the first cold head 14*a* to the distal end thereof so as to narrow the first expansion chamber 20*a*), the second displacer 16*b* moves from the bottom dead center to the top dead center (that is, the second displacer 16*b* moves from the distal end of the second cold head 14*b* to the proximal end thereof so as to widen the second expansion chamber 20*b*).

As shown in FIG. 2, a refrigerant circulation circuit 54 is provided in the GM cryocooler 10. The GM cryocooler 10 cools a refrigerant (for example, liquid nitrogen) which flows through the refrigerant circulation circuit 54. The refrigerant cooled by the GM cryocooler 10 is supplied to an object to be cooled (not shown) through the refrigerant circulation circuit 54. The refrigerant used so as to cool the object to be cooled is recovered through the refrigerant circulation circuit 54, and is re-cooled by the GM cryocooler 10.

The refrigerant circulation circuit 54 includes a first refrigerant cooling unit 54*a* which is thermally coupled to the first cold head 14*a*, a second refrigerant cooling unit 54*b* which is thermally coupled to the second cold head 14*b*, and a connection refrigerant pipe 54*c* which connects the first refrigerant cooling unit 54*a* to the second refrigerant cooling unit 54*b*. In addition, the refrigerant circulation circuit 54 includes a supply pipe 54*d* and a recovery pipe 54*e*. Each of the first refrigerant cooling unit 54*a* and the second refrigerant cooling unit 54*b* is a spiral refrigerant pipe which is wound around the first cooling stage 24*a* and the second cooling stage 24*b*. The first refrigerant cooling unit 54*a* is cooled by the first cooling stage 24*a*, and the second refrigerant cooling unit 54*b* is cooled by the second cooling stage 24*b*. The connection refrigerant pipe 54*c* is connected to one end of the first refrigerant cooling unit 54*a*, and the supply pipe 54*d* is connected to the other end thereof. The connection refrigerant pipe 54*c* is connected to one end of the second refrigerant cooling unit 54*b*, and the recovery pipe 54*e* is connected to the other end thereof.

A detachable connection mechanism 54*f* is provided in the connection refrigerant pipe 54*c*. Accordingly, when the connection mechanism 54*f* is removed, the portion of the connection refrigerant pipe 54*c* on the first refrigerant cooling unit 54*a* side and the portion of the connection refrigerant pipe 54*c* on the second refrigerant cooling unit 54*b* side are separated from each other. According to the connection mechanism 54*f*, disassembly of the refrigerant circulation circuit 54 is easily performed. This contributes to an increase in efficiency of maintenance work of the GM cryocooler 10.

Flow directions of the refrigerant in the refrigerant circulation circuit 54 are shown by arrows. The refrigerant flows from the recovery pipe 54*e* to the supply pipe 54*d* through the second refrigerant cooling unit 54*b*, the connection refrigerant pipe 54*c*, and the first refrigerant cooling unit 54*a*. In this way, first, the refrigerant is cooled by the second refrigerant cooling unit 54*b*, and thereafter, is cooled by the first refrigerant cooling unit 54*a*.

The cold head has a highest freeze capacity when the cold head is installed in a posture in which the expansion chamber is positioned downward in the vertical direction. As described above, the first cold head 14*a* has first expansion chamber 20*a* on the lower side in the vertical direction. However, the second cold head 14*b* does not have the second expansion chamber on the lower side in the vertical direction. Accordingly, the temperature of the second cooling stage 24*b* is higher than the temperature of the first cooling stage 24*a*. According to the above-described refrigerant circuit configuration, first, the recovered refrigerant having a relatively high temperature is cooled by the second cold head 14*b* having a high temperature, and thereafter, is cooled by the first cold head 14*a* having a low temperature. Accordingly, it is possible to improve heat exchange efficiency between the refrigerant and the GM cryocooler 10.

In addition, the GM cryocooler 10 includes an auxiliary vacuum vessel 56 in which the second cold head 14*b* and the second refrigerant cooling unit 54*b* are accommodated, and a flanged portion 60 for attaching the first cold head 14*a* to a main vacuum vessel 58 separated from the auxiliary vacuum vessel 56. The first cold head 14*a* and the first refrigerant cooling unit 54*a* are accommodated in the main vacuum vessel 58.

The auxiliary vacuum vessel 56 is attached to the proximal end of the second cylinder 18*b*, and the flanged portion 60 is attached to the proximal end of the first cylinder 18*a*. The auxiliary vacuum vessel 56 is connected to the flanged portion 60 by a connection pipe 62 which allows the auxiliary vacuum vessel 56 to airtightly communicate with the main vacuum vessel 58. The connection pipe 62 provided a passage through which the supply pipe 54*d* and the connection refrigerant pipe 54*c* are introduced from the main vacuum vessel 58 to the auxiliary vacuum vessel 56. The connection pipe 62 has a bellows portion midway.

The second cold head 14*b* and the second refrigerant cooling unit 54*b* are covered with the auxiliary vacuum vessel 56, and only the first cold head 14*a* and the first refrigerant cooling unit 54*a* are exposed. Therefore, in an operation in which the GM cryocooler 10 is attached to the main vacuum vessel 58, an operator can handle the GM cryocooler 10 as a general GM cryocooler having a single cold head.

The working gas circuit 70 shown in FIG. 1 is configured so as to generate a pressure difference between a first gas chamber (that is, first expansion chamber 20*a* and/or first room-temperature chamber 22*a*) and a second gas chamber (that is, second expansion chamber 20*b* and/or second room-temperature chamber 22*b*). The pressure difference acts on the displacer connector 16 so as to assist the common drive mechanism 40. In FIG. 1, when the displacer connector 16 moves downward (that is, when the first (second) displacer 16*a* (16*b*) moves from the top (bottom) dead center to the bottom (top) dead center), the working gas circuit 70 increases the pressure of the second gas chamber with respect to the first gas chamber. In this way, it is possible to assist the downward movement of the displacer connector 16 by the pressure difference between the first gas chamber and the second gas chamber, and vice versa.

The working gas circuit 70 includes a valve portion 72. The valve portion 72 includes a first intake valve V1, a first exhaust valve V2, a second intake valve V3, and a second exhaust valve V4. The valve portion 72 is accommodated in the drive mechanism housing 52 shown in FIG. 2. The valve portion 72 may be a rotary type valve. In this case, the valve portion 72 may be connected to the rotation output shaft 46 so as to be rotationally driven by the rotation of a rotation drive source 44. Alternatively, the valve portion 72 may include a plurality of control valves which are individually controllable, and a controller which controls the control valve.

The first intake valve V1 is configured so as to determine a first intake period A1 of the first cold head 14*a*. The first intake valve V1 is disposed in a first intake flow path 74*a* which connects a discharge port of the compressor 12 to the first room-temperature chamber 22*a* of the first cold head 14*a*. In the first intake period A1 (that is, when the first intake valve V1 opens), the working gas flows from the discharge port of the compressor 12 into the first room-temperature chamber 22*a*. Inversely, when the first intake valve V1 is closed, the supply of the working gas from the compressor 12 to the first room-temperature chamber 22*a* is stopped.

The first exhaust valve V2 is configured so as to determine a first exhaust period A2 of the first cold head 14*a*. The first intake valve V2 is disposed in a first exhaust flow path 76*a* which connects a suction port of the compressor 12 to the first room-temperature chamber 22*a* of the first cold head 14*a*. In the first exhaust period A2 (that is, when the first exhaust valve V2 opens), the working gas flows from the first room-temperature chamber 22*a* into the suction port of the compressor 12. When the first exhaust valve V2 is closed, the recovery of the working gas from the first room-temperature chamber 22*a* to the compressor 12 is stopped. As shown in FIG. 1, a portion of the first exhaust flow path 76*a* and the first intake flow path 74*a* may share each other on the first room-temperature chamber 22*a* side.

Similarly, the second intake valve V3 is configured so as to determine a second intake period A3 of the second cold head 14*b*. The second intake valve V3 is disposed in a second intake flow path 74*b* which connects the discharge port of the compressor 12 to the second room-temperature chamber 22*b* of the second cold head 14*b*. In the second intake period A3 (that is, when the second intake valve V3 opens), the working gas flows from the discharge port of the compressor 12 into the second room-temperature chamber 22*b*. When the second intake valve V3 is closed, the supply of the working gas from the compressor 12 to the second room-temperature chamber 22*b* is stopped. As shown in FIG. 1, a portion of the second intake flow path 74*b* and the first intake flow path 74*a* may share each other on the compressor 12 side.

The second exhaust valve V4 is configured so as to determine a second exhaust period A4 of the second cold head 14*b*. The second exhaust valve V4 is disposed in a second exhaust flow path 76*b* which connects the suction port of the compressor 12 to the second room-temperature chamber 22*b* of the second cold head 14*b*. In the second exhaust period A4 (that is, when the second exhaust valve V4 opens), the working gas flows from the second room-temperature chamber 22*b* to the suction port of the compressor 12. When the second exhaust valve V4 is closed, the recovery of the working gas from the second room-temperature chamber 22*b* to the compressor 12 is stopped. As shown in FIG. 1, a portion of the second exhaust flow path 76*b* and the second intake flow path 74*b* may share each other on the second room-temperature chamber 22*b* side. Moreover, a portion of the second exhaust flow path 76*b* and the first exhaust flow path 76*a* may share each other on the compressor 12 side.

In FIG. 3, the first intake period A1, the first exhaust period A2, the second intake period A3, and the second exhaust period A4 are exemplified. In FIG. 3, one period in the axial reciprocation of the displacer connector 16 is shown so as to correspond to 360°, 0° corresponds to a starting time of the period, and 360° corresponds to an end time of the period. 90°, 180°, and 270° respectively correspond to a ¼ period, a half period, and a ¾ period.

The first intake period A1 and the second exhaust period A4 are within a range from 0° to 135°, and the first exhaust period A2 and the second intake period A3 are within a range from 180° to 315°. The first intake period A1 and the first exhaust period A2 are alternately positioned to each other, and the second intake period A3 and the second exhaust period A4 are alternately positioned to each other. The first (second) displacer 16*a* (16*b*) is positioned at the bottom (top) dead center or in the vicinity thereof at 0°, and the first (second) displacer 16*a* (16*b*) is positioned at the top (bottom) dead center or in the vicinity thereof at 180°.

The operation of the GM cryocooler 10 having the above-described configuration will be described. When the first displacer 16*a* is positioned at the bottom dead center of the first cylinder 18*a* or in the vicinity thereof, the first intake period A1 starts (0° in FIG. 3). The first intake valve V1 opens, and a high-pressure gas is supplied from the discharge port of the compressor 12 to the first room-temperature chamber 22*a* of the first cold head 14*a*. Gas is cooled while passing through the first regenerator 26*a*, and enters the first expansion chamber 20*a*. While the gas flows into the first cold head 14*a*, the first displacer 16*a* moves from the bottom dead center toward the top dead center. The first intake valve V1 is closed, and the first intake period A1 ends (135° in FIG. 3). The first displacer 16*a* continuously moves toward the top dead center. In this way, the volume of the first expansion chamber 20*a* increases, and the first expansion chamber 20*a* is filled with a high-pressure gas.

When the first displacer 16*a* positioned at the top dead center or in the vicinity thereof, the first exhaust period A2 starts (180° in FIG. 3). The first exhaust valve V2 opens and the first cold head 14*a* is connected to the suction port of the compressor 12. A high-pressure gas is expanded in the first expansion chamber 20*a* and is cooled. The expanded gas is recovered to the compressor 12 via the first room-temperature chamber 22*a* while cooling the first regenerator 26*a*. While the gas flows out from the first cold head 14*a*, the first displacer 16*a* moves from the top dead center toward the bottom dead center. The first exhaust valve V2 is closed, and the first exhaust period A2 ends (315° in FIG. 3). The first displacer 16*a* continuously moves toward the bottom dead center. In this way, the volume of the first expansion chamber 20*a* decreases, and a low-pressure gas is discharged.

The first cold head 14*a* repeats the cooling cycle (that is, GM cycle), and thus, the first cooling stage 24*a* is cooled. Accordingly, the refrigerant is cooled by the first refrigerant cooling unit 54*a*.

Simultaneously with the above-described operation of the first cold head 14*a*, the second cold head 14*b* is operated. When the second displacer 16*b* positioned at the top dead center or in the vicinity thereof, the second exhaust period A4 starts (0° in FIG. 3). The second exhaust valve V4 opens and the second cold head 14*b* is connected to the suction port of the compressor 12. A high-pressure gas is expanded in the second expansion chamber 20*b* and is cooled. The expanded gas is recovered to the compressor 12 via the second room-temperature chamber 22*b* while cooling the second regenerator 26*b*. While the gas flows out from the second cold head 14*b*, the second displacer 16*b* moves from the top dead center toward the bottom dead center (upward in the FIG. 1). The second exhaust valve V4 is closed, and the second exhaust period A4 ends (135° in FIG. 3). The second displacer 16*b* continuously moves toward the bottom dead center. In this way, the volume of the second expansion chamber 20*b* decreases, and a low-pressure gas is discharged.

When the second displacer 16*b* positioned at the bottom dead center of the second cylinder 18*b* or in the vicinity thereof, the second intake period A3 starts (180° in FIG. 3). The second intake valve V3 opens, and a high-pressure gas is supplied from the discharge port of the compressor 12 to the second room-temperature chamber 22*b* of the second cold head 14*b*. Gas is cooled while passing through the second regenerator 26*b*, and enters the second expansion chamber 20*b*. While the gas flows into the second cold head 14*b*, the second displacer 16*b* moves from the bottom dead center toward the top dead center (downward in FIG. 1). The second intake valve V3 is closed, and the second intake period A3 ends (135° in FIG. 3). The second displacer 16*b* continuously moves toward the top dead center. In this way, the volume of the second expansion chamber 20*b* increases, and the second expansion chamber 20*b* is filled with a high-pressure gas.

In this way, in the second cold head 14*b*, the cooling cycle (that is, GM cycle) which has a phase opposite to the phase of the first cold head 14*a* but is similar to the cycle of first cold head 14*a* is repeated. Accordingly, the second cooling stage 24*b* is cooled, and the refrigerant is cooled by the second refrigerant cooling unit 54*b*.

In the expander of the GM cryocooler, there is a technology referred to as so-called "gas assist" using a gas pressure in order to decrease the drive torque. Typical gas assist is realized by distributing a portion of the supplied working gas to a gas assist chamber inside the expander separated from the expansion space. The working gas supplied to the gas assist chamber cannot contribute to PV work in the expansion space. Accordingly, in the gas assist, there is a disadvantage that a decrease in the PV work may occur, that is, a decrease in freezing capacity may occur.

However, in the above-described embodiment, the first intake period A1 overlaps the second exhaust period A4. Accordingly, when gas is supplied from the compressor 12 to the first cold head 14*a*, the gas is recovered from the second cold head 14*b* to the compressor 12. In this case, the pressure of the first expansion chamber 20*a* is higher than the pressure of the second expansion chamber 20*b*, and this pressure difference biases the displacer connector 16 upward in the FIG. 1. Since the direction of the biasing force coincides with the movement direction of the displacer connector 16, it is possible to assist the common drive mechanism 40 by the pressure difference.

In addition, since the first exhaust period A2 overlaps the second intake period A3, when gas is recovered from the first cold head 14*a*, gas is supplied to the second cold head 14*b*, and the pressure of the first expansion chamber 20*a* is lower than the pressure of the second expansion chamber 20*b*. This pressure difference biases the displacer connector 16 downward in FIG. 1. Accordingly, similarly to the first intake period A1, in the first exhaust period A2, it is possible to assist the common drive mechanism 40 by the pressure difference.

Accordingly, operations of the first cold head 14*a* and the second cold head 14*b* themselves provide the gas assist to the displacer connector 16. As the above-described typical gas assist configuration, the working gas is not consumed in the dedicated gas assist chamber, and thus, loss of the PV work does not occur. Therefore, it is possible to decrease the drive torque generated by the common drive mechanism 40 to drive the displacer connector 16, and thus, a decrease in a size of the drive mechanism can be obtained.

In order to obtain the above-described advantages, the first intake period A1 and the second exhaust period A4 may not correctly coincide with each other. The second exhaust period A4 may at least partially overlap the first intake period A1. Similarly, the first exhaust period A2 and the second intake period A3 may not correctly coincide with each other. The second intake period A3 may at least partially overlap the first exhaust period A2.

In the above-described embodiment, the second intake period A3 does not overlap the first intake period A1. In addition, the second exhaust period A4 does not overlap the first exhaust period A2. In this way, the intake-exhaust cycle from the compressor 12 to the first cold head 14*a* is completely deviated from the intake-exhaust cycle from the compressor 12 to the second cold head 14*b*. Accordingly, variation between a high pressure and a low pressure of the compressor 12 decreases, and thus, it is possible to improve efficiency of the compressor 12.

In order to obtain the advantages, the intake-exhaust cycles of the two cold heads need not be completely deviated from each other. Preferably, the second intake period A3 may be later than first intake period A1 by 150° or more. Along with this, or instead of this, preferably, the second exhaust period A4 may be later than the first exhaust period A2 by 150° or more.

In addition, lengths of the first intake period A1 and the second exhaust period A4 may be different from each other. Similarly, lengths of the first exhaust period A2 and the second intake period A3 may be different from each other. For example, the difference between the intake period and the exhaust period may be within 20° or 5°. In this way, the difference between freezing capacities of the first cold head 14*a* and the second cold head 14*b* may be adjusted.

In addition, the lengths of the first intake period A1 and the first exhaust period A2 may be different from each other. Similarly, the lengths of the second intake period A3 and the second exhaust period A4 may be different from each other. In this case, for example, the difference between the intake period and the exhaust period may be within 20° or 5°.

Moreover, in the above-described embodiment, since the GM cryocooler 10 is installed such that the two cold heads disposed to face each other are positioned in the longitudinal direction, it is possible to reduce the area of floor for installation of the GM cryocooler 10.

In the GM cryocooler 10 described with reference to FIGS. 1 to 3, the common drive mechanism 40 is assisted by the working gas circuit 70. However, it is possible to drive the displacer connector 16 by only the pressure difference between the two cold heads. That is, as shown in FIG. 4, the GM cryocooler 10 may not have the common drive mechanism 40.

Figure 4:
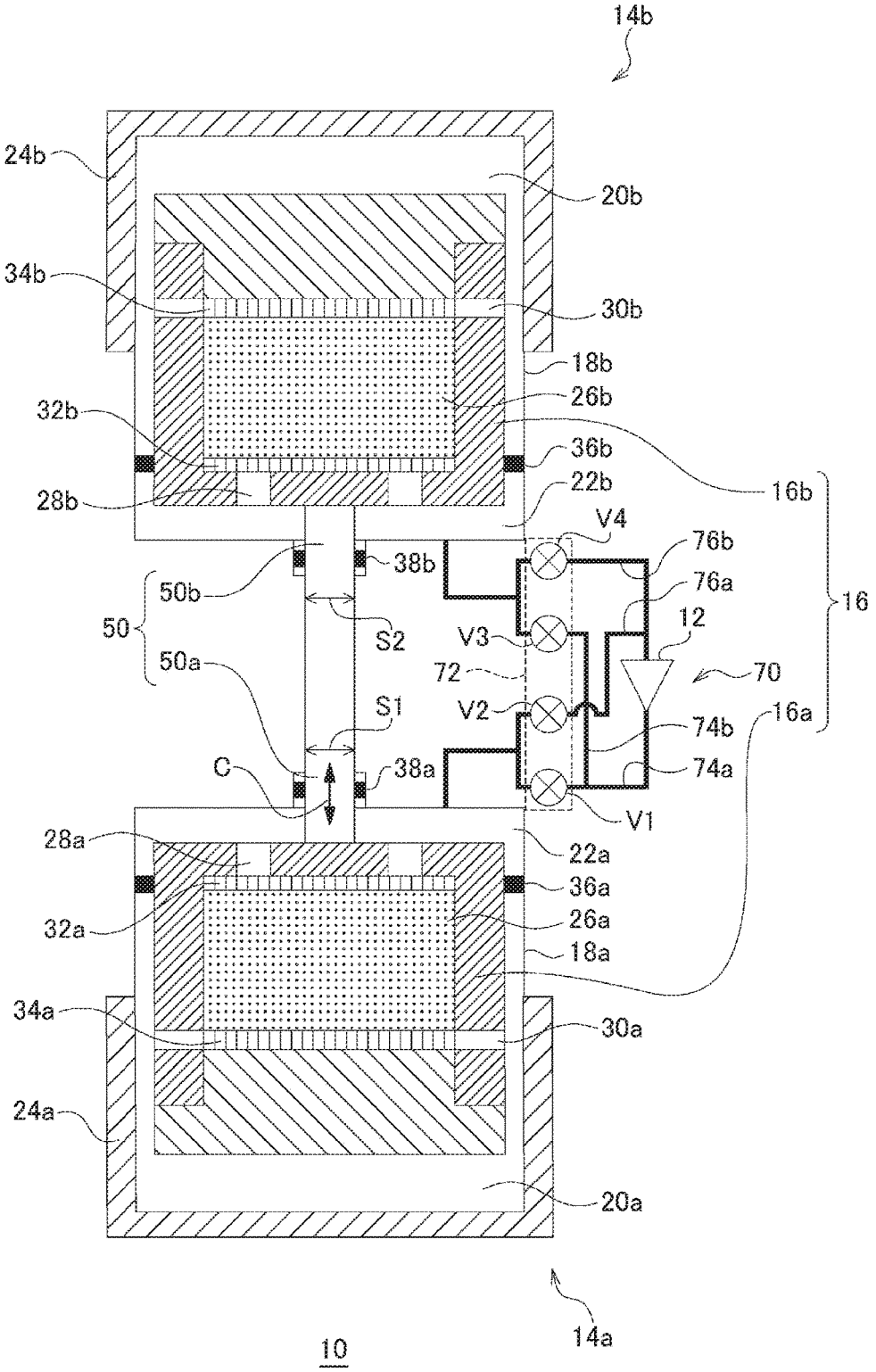
FIG. 4 is a sectional view schematically showing a GM cryocooler according to another embodiment of the present invention.

FIG. 4 is a sectional view schematically showing the GM cryocooler 10 according to another embodiment of the present invention. The GM cryocooler 10 includes the first connection rod 50*a* and the second connection rod 50*b*, and the first connection rod 50*a* and the second connection rod 50*b* are axially connected to each other. The first displacer 16*a* is connected to the second displacer 16*b* via the first connection rod 50*a* and the second connection rod 50*b* such that the axial reciprocation of the first displacer 16*a* has the phase opposite to the phase of the axial reciprocation of the second displacer 16*b*. The relative position of the second displacer 16*b* with respect to the first displacer 16*a* is not changed during the axial reciprocation of the first displacer 16*a* and the second displacer 16*b*. The first displacer 16*a*, the first connection rod 50*a*, the second connection rod 50*b*, and the second displacer 16*b* are coaxially disposed with respect to each other.

The first connection rod 50*a* and the second connection rod 50*b* configure a single connection rod 50 which is fixedly connected to each other. Alternatively, the first connection rod 50*a* and the second connection rod 50*b* may be fixedly connected to each other via an intermediate member.

The first connection rod 50*a* has a first cross-sectional area S1 in a plane perpendicular to the axial direction, and the second connection rod 50*b* has a second cross-sectional area S2 in a plane perpendicular to the axial direction. The first cross-sectional area S1 is the same as the second cross-sectional area S2. For example, the first connection rod 50*a* may have a circular cross-section having a first diameter, and the second connection rod 50*b* may have a circular cross-section having a second diameter which is the same as the first diameter. Typically, the first connection rod 50*a* and the second connection rod 50*b* have the same cross-sectional shape as each other. However, both may have cross-sectional shapes different from each other.

The working gas circuit 70 is configured so as to drive the axial reciprocation of the first displacer 16*a* and the second displacer 16*b*. The working gas circuit 70 is connected to the first cold head 14*a* and the second cold head 14*b* so as to generate the pressure difference between the first gas chamber and the second gas chamber.

Similarly to the GM cryocooler 10 shown FIG. 1, in the GM cryocooler 10 shown in FIG. 4, the valve timing shown in FIG. 3 is adopted.

The first intake period A1 overlaps the second exhaust period A4. Accordingly, when gas is supplied from the compressor 12 to the first cold head 14*a*, the gas is recovered from the second cold head 14*b* to the compressor 12. In this case, the pressure of the first expansion chamber 20*a* is higher than the pressure of the second expansion chamber 20*b*. In this way, it is possible to move the displacer connector 16 upward by the pressure difference.

In addition, the first exhaust period A2 overlaps the second intake period A3. Gas is supplied to the second cold head 14*b* when gas is recovered from the first cold head 14*a*, and thus, the pressure of the first expansion chamber 20*a* is lower than the pressure of the second expansion chamber 20*b*. It is possible to move the displacer connector 16 downward by the pressure difference.

In this way, it is possible to provide the GM cryocooler 10 which does not have the common drive mechanism 40. The GM cryocooler 10 is configured of a gas differential-pressure drive type cryocooler. In addition, in a case where the valve portion 72 is configured of a rotary valve, as described above, the GM cryocooler 10 may include a drive source (for example, rotation drive source 44) which is connected to a rotary valve so as to rotationally drive the rotary valve.

In addition, in the GM cryocooler 10 shown in FIG. 1, the first connection rod 50*a* has a first cross-sectional area in a plane perpendicular to the axial direction, and the second connection rod 50*b* has a second cross-sectional area in a plane perpendicular to the axial direction. The first cross-sectional area S1 is the same as the second cross-sectional area S2. For example, the first connection rod 50*a* may have a circular cross-section having a first diameter, and the second connection rod 50*b* may have a circular cross-section having a second diameter which is the same as the first diameter.

Figure 5:
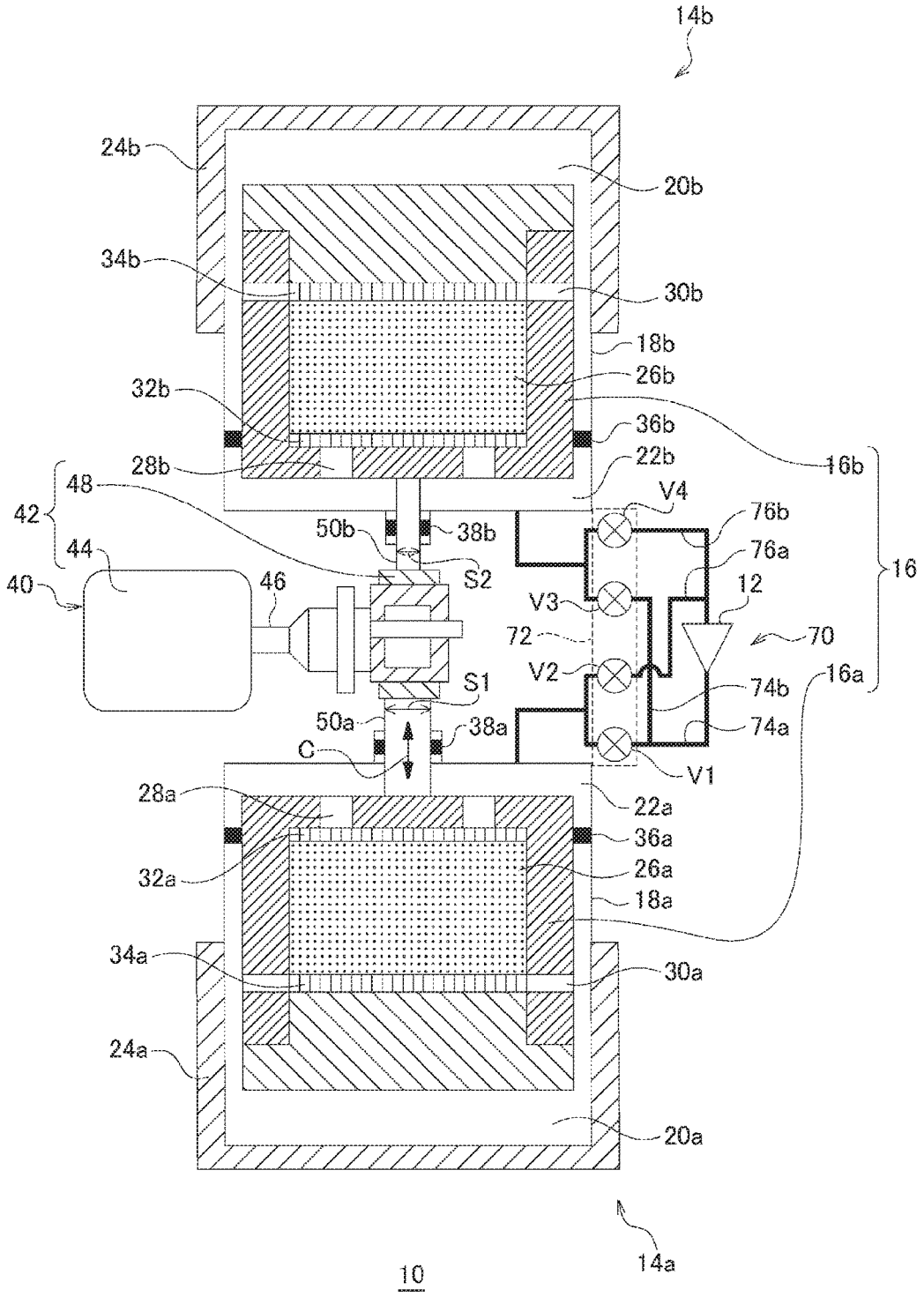
FIG. 5 is a sectional view schematically showing a GM cryocooler according to still another embodiment of the present invention.

FIG. 5 is a sectional view schematically showing the GM cryocooler 10 according to still another embodiment of the present invention. In the GM cryocooler 10 described with reference to FIGS. 1 to 4, the first connection rod 50*a* and the second connection rod 50*b* have the same cross-sectional area as each other. However, as shown in FIG. 5, the first connection rod 50*a* and the second connection rod 50*b* may have cross-sectional areas different from each other.

The first connection rod 50*a* has the first cross-sectional area S1 in a plane perpendicular to the axial direction, and the second connection rod 50*b* has the second cross-sectional area S2 in a plane perpendicular to the axial direction. The first cross-sectional area S1 is different from the second cross-sectional area S2. For example, the first cross-sectional area S1 is greater than the second cross-sectional area S2. For example, the first connection rod 50*a* has a circular cross-section having a first diameter, and the second connection rod 50*b* has a circular cross-section having a second diameter. The second diameter is smaller than the first diameter.

Accordingly, the working gas circuit 70 can generate a pressure difference assisting the common drive mechanism 40. The operations of the first cold head 14*a* and the second cold head 14*b* themselves provide the gas assist to the displacer connector 16.

Moreover, the GM cryocooler 10 shown in FIG. 5 has an asymmetrical gas assist configuration in which the first cross-sectional area S1 is different from the second cross-sectional area S2. Different assist forces are applied to the displacer connector 16 according to the movement directions of the displacer connector 16.

Figure 6B:
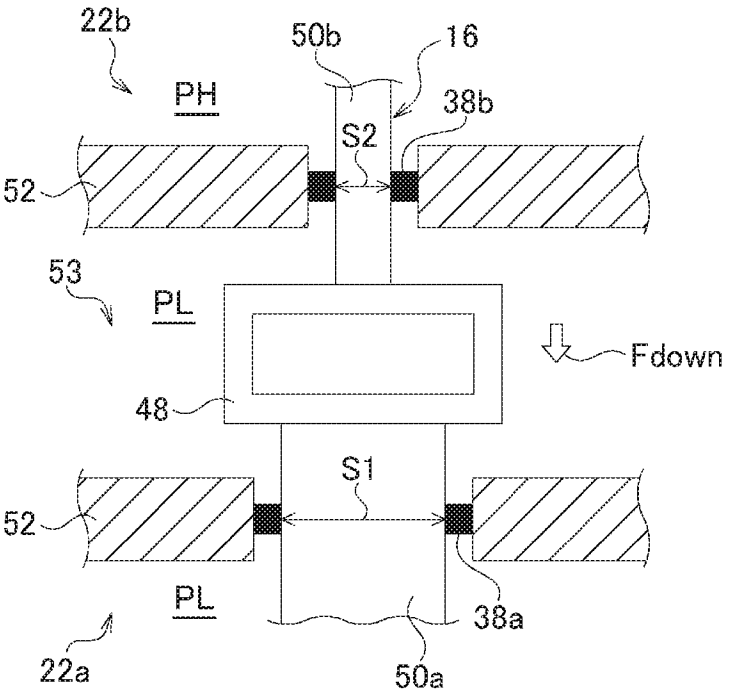
FIG. 6B shows a downward assist force which acts on the Scotch yoke when the displacer connector moves downward.
Figure 6A:
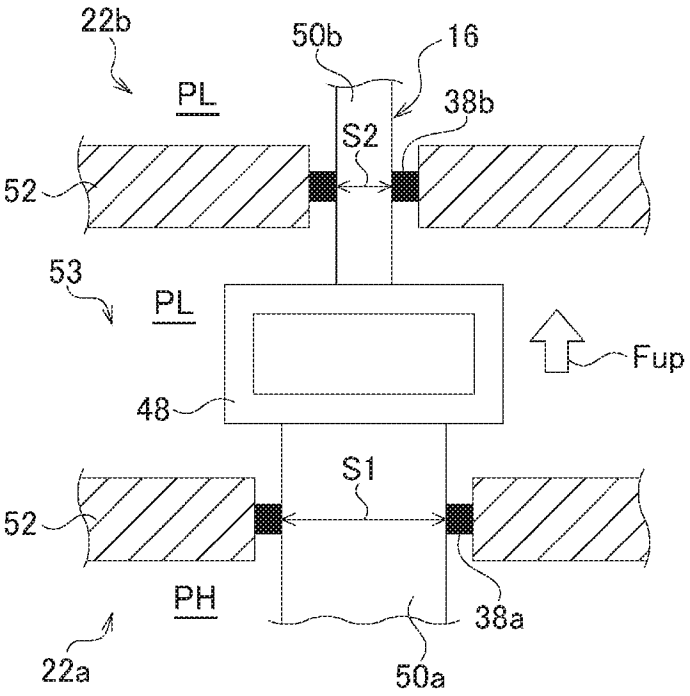
FIG. 6A shows an upward assist force which acts on a Scotch yoke when a displacer connector shown in FIG. 5 moves upward.

FIG. 6A shows a upward assist force Fup which acts on the Scotch yoke 48 when the displacer connector 16 shown in FIG. 5 moves upward, and FIG. 6B shows a downward assist force Fdown which acts on the Scotch yoke 48 when the displacer connector 16 moves downward.

The Scotch yoke 48 is accommodated in an internal space 53 of the drive mechanism housing 52. As described above, the first bearing portion 38*a* and the second bearing portion 38*b* respectively seal the first room-temperature chamber 22*a* and the second room-temperature chamber 22*b* from the internal space 53. The internal space 53 communicates with the discharge port of the compressor 12 shown in FIG. 1, and accordingly, is always maintained to a low pressure PL.

When the displacer connector 16 moves upward, since the first room-temperature chamber 22*a* is a high pressure PH and the second room-temperature chamber 22*b* is a low pressure PL, the upward assist force Fup is represented by Fup=(PH−PL) S1. Meanwhile, when the displacer connector 16 moves upward, since the first room-temperature chamber 22*a* is a low pressure PL and the second room-temperature chamber 22*b* is a high pressure PH, the downward assist force Fdown is represented by Fdown=(PH−PL) S2. Accordingly, in a case where the first cross-sectional area S1 is greater than the second cross-sectional area S2, the upward assist force Fup is greater than the downward assist force Fdown.

The GM cryocooler 10 is installed in the shown direction in the use site thereof. That is, the first cold head 14*a* is disposed downward in the vertical direction, the second cold head 14*b* is disposed upward in the vertical direction, and thus, the GM cryocooler 10 is installed in a longitudinal direction. In this case, the load of the drive source (for example, rotation drive source 44) may be different from each other according to the movement directions of the displacer connector 16. For example, due to the weight of the displacer connector 16 itself, the load of the drive source (for example, the rotation drive source 44) when the displacer connector 16 moves upward may be greater than the load of the drive source when the displacer connector 16 moves downward.

The GM cryocooler 10 shown in FIG. 5 adopts the asymmetrical gas assist configuration, and thus, it is possible to uniformize drive loads. For example, the first cross-sectional area S1 is greater than the second cross-sectional area S2, and thus, the upward assist force Fup is greater than the downward assist force Fdown. Accordingly, it is possible to at least partially eliminate influences of the ownweight of the displacer connector 16. This contributes to uniformization of freezing performance of the first cold head 14*a* and the second cold head 14*b*. In addition, since a peak value of the drive load decreases due to uniformization of the drive load, the asymmetrical gas assist configuration contributes to a decrease in size of the drive source.

In an embodiment, the internal space 53 of the drive mechanism housing 52 may be maintained to a predetermined pressure different from the low pressure PL. Similarly, it is possible to apply assist forces different from each other to the displacer connector 16 according to the movement direction of the displacer connector 16.

In an embodiment, the first cross-sectional area S1 of the first connection rod 50*a* may be smaller than the second cross-sectional area S2 of the second connection rod 50*b*. For example, the first connection rod 50*a* has a circular cross-section having a first diameter, the second connection rod 50*b* has a circular cross-section having a second diameter, and the first diameter may be smaller than the second diameter. In this way, the upward assist force Fup can be smaller than the downward assist force Fdown.

Figure 7:
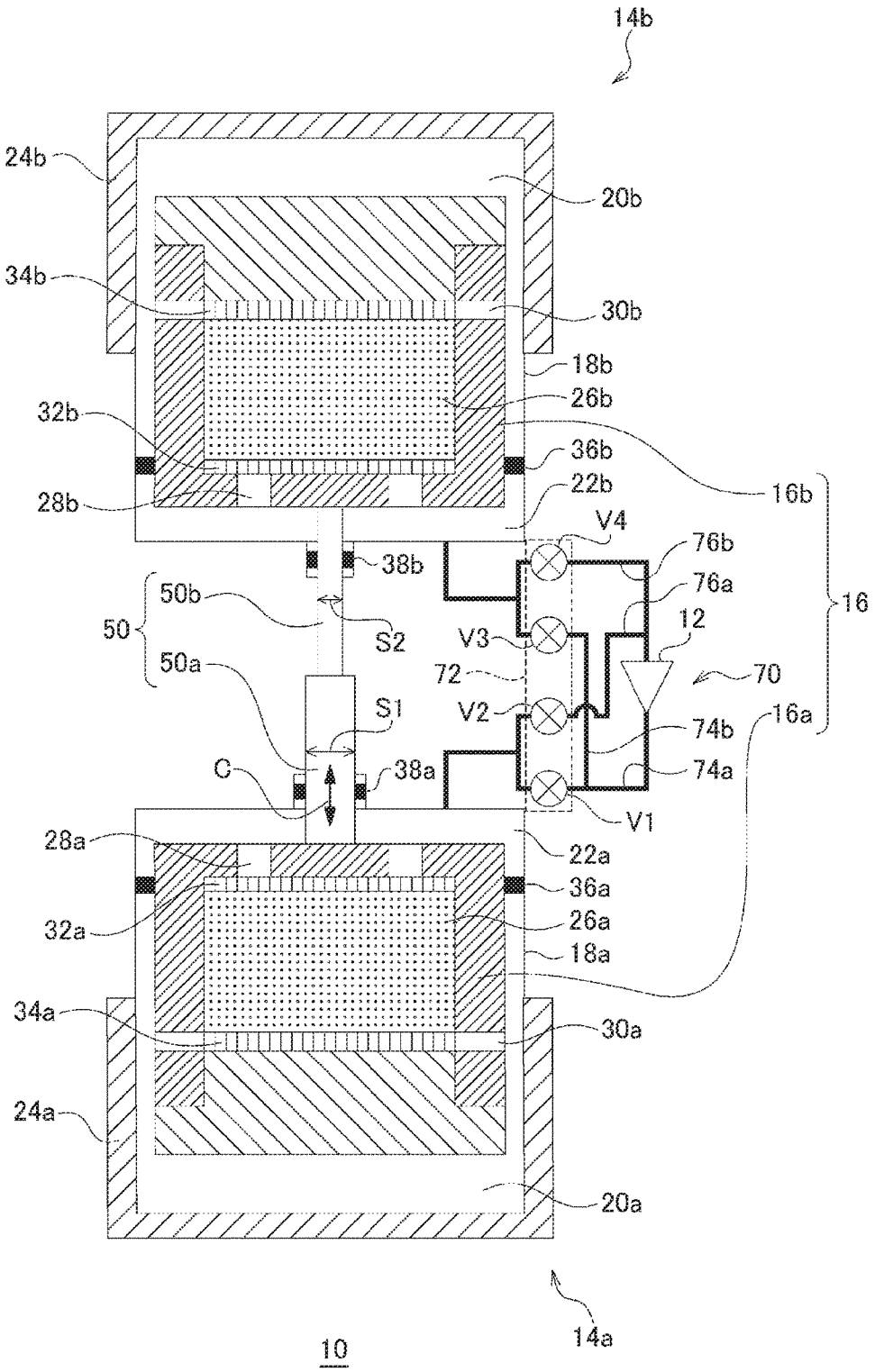
FIG. 7 is a sectional view schematically showing a GM cryocooler according to still another embodiment of the present invention.

FIG. 7 is a sectional view schematically showing a GM cryocooler 10 according to still another embodiment of the present invention. Similarly to the GM cryocooler 10 shown in FIG. 4, the GM cryocooler 10 shown in FIG. 7 does not have the common drive mechanism 40.

The GM cryocooler 10 includes the first connection rod 50*a* and the second connection rod 50*b*, and the first connection rod 50*a* and the second connection rod 50*b* are axially connected to each other. The first displacer 16*a* is connected to the second displacer 16*b* via the first connection rod 50*a* and the second connection rod 50*b* such that the axial reciprocation of the first displacer 16*a* has the phase opposite to the phase of the axial reciprocation of the second displacer 16*b*. The relative position of the second displacer 16*b* with respect to the first displacer 16*a* is not changed during the axial reciprocation of the first displacer 16*a* and the second displacer 16*b*.

The first connection rod 50*a* and the second connection rod 50*b* configure a single connection rod 50 which is fixedly connected to each other. Alternatively, the first connection rod 50*a* and the second connection rod 50*b* may be fixedly connected to each other via an intermediate member.

The first connection rod 50*a* has the first cross-sectional area S1 in a plane perpendicular to the axial direction, and the second connection rod 50*b* has the second cross-sectional area S2 in a plane perpendicular to the axial direction. The first cross-sectional area S1 is different from the second cross-sectional area S2. For example, the first cross-sectional area S1 is greater than the second cross-sectional area S2. For example, the first connection rod 50*a* has a circular cross-sectional area having a first diameter, and the second connection rod 50*b* has a circular cross-section having a second diameter. The second diameter is smaller than the first diameter.

Similarly to the GM cryocooler 10 shown FIG. 1, in the GM cryocooler 10 shown in FIG. 7, the valve timing shown in FIG. 3 is adopted.

In this way, the GM cryocooler 10 can be configured of a gas differential-pressure drive type cryocooler. In addition, it is possible to apply drive forces different from each other to the displacer connector 16 according to the movement direction of the displacer connector 16. Accordingly, the upward movement and the downward movement of the displacer connector 16 can be symmetrized to each other. It is possible to uniformize the freezing performance of the first cold head 14*a* and the second cold head 14*b*.

It should be understood that the invention is not limited to the above-described embodiment, but may be modified into various forms on the basis of the spirit of the invention. Additionally, the modifications are included in the scope of the invention.

For example, two cold heads may have configurations different from each other. The first cold head 14*a* and the second cold head 14*b* have sizes different from each other, and thus, may have freezing capacities different from each other. Alternatively, one or both of the first cold head 14*a* and the second cold head 14*b* may be multiple-staged cold head (for example, two-staged cold head).

The reciprocation drive source 42 may have a linear motor which drives the axial reciprocation of the first displacer 16*a* and the second displacer 16*b*.

What is claimed is:

1. A Gifford-McMahon (GM) cryocooler, comprising:

a first cold head including an axially reciprocatory first displacer, and a first cylinder, with a first gas chamber being formed between the first displacer and the first cylinder;

a first refrigerant cooling unit thermally coupled to the first cold head;

a second cold head disposed opposing the first cold head, and including a second displacer disposed coaxially with respect to the first displacer and being axially reciprocatory unitarily with the first displacer, and a second cylinder, with a second gas chamber being formed between the second displacer and the second cylinder;

a second refrigerant cooling unit thermally coupled to the second cold head;

a connection refrigerant pipe connecting the first refrigerant cooling unit to the second refrigerant cooling unit;

a connection mechanism detachably provided on the connection refrigerant pipe;

a common drive mechanism connected to the first displacer and the second displacer such as to drive axial reciprocation of the first displacer and the second displacer; and a working gas circuit connected to the first cold head and the second cold head such as to generate between the first gas chamber and the second gas chamber a pressure differential assisting the common drive mechanism.

2. The GM cryocooler according to claim 1, wherein:

the common drive mechanism includes a reciprocation drive source, a first connection rod longitudinal-axially extending from the reciprocation drive source and connecting the reciprocation drive source to the first displacer, and a second connection rod longitudinal-axially extending from the reciprocation drive source on a side thereof opposite from the first connection rod, and connecting the reciprocation drive source to the second displacer; and the axial reciprocation of the first displacer is of phase inverse from that of the axial reciprocation of the second displacer.

3. The GM cryocooler according to claim 2, wherein:

the reciprocation drive source includes a rotation drive source having a rotation output shaft, and a Scotch yoke connected to the rotation output shaft such as to convert rotation of the rotation output shaft into axial reciprocation;

the first connection rod axially extends from the Scotch yoke to the first displacer and connects the Scotch yoke to the first displacer; and the second connection rod axially extends from the Scotch yoke to the second displacer and connects the Scotch yoke to the second displacer.

4. The GM cryocooler according to claim 2, wherein the first connection rod is of first cross-sectional area in a plane perpendicular to the first connection rod's axis, the second connection rod is of second cross-sectional area in a plane perpendicular to the second connection rod's axis, and the first cross-sectional area and the second cross-sectional area are equal.

5. The GM cryocooler according to claim 2, wherein the first connection rod is of first cross-sectional area in a plane perpendicular to the first connection rod's longitudinal axis, the second connection rod is of second cross-sectional area in a plane perpendicular to the second connection rod's longitudinal axis, and the first cross-sectional area and the second cross-sectional area differ.

6. The GM cryocooler according to claim 1, wherein the working gas circuit includes:

a first intake valve determining a first intake period of the first cold head;

a second intake valve determining a second intake period of the second cold head;

a first exhaust valve determining a first exhaust period of the first cold head such that the first exhaust period and the second intake period at least partially overlap each other; and a second exhaust valve determining a second exhaust period of the second cold head such that the second exhaust period and the first intake period at least partially overlap each other.

7. The GM cryocooler according to claim 6, wherein at least either the second intake period lags the first intake period, or the second exhaust period lags the first exhaust period.

8. The GM cryocooler according to claim 1, further comprising:

an auxiliary vacuum vessel accommodating the second cold head and the second refrigerant cooling unit; and a flanged portion attaching the first cold head to a main vacuum vessel different from the auxiliary vacuum vessel.

9. A Gifford-McMahon (GM) cryocooler, comprising;

a first cold head including an axially reciprocatory first displacer, and a first cylinder, with a first gas chamber being formed between the first displacer and the first cylinder;

a first refrigerant cooling unit thermally coupled to the first cold head;

a second cold head disposed opposing the first cold head, and including a second displacer disposed coaxially with respect to the first displacer and being axially reciprocatory unitarily with the first displacer, and a second cylinder, with a second gas chamber being formed between the second displacer and the second cylinder;

a second refrigerant cooling unit thermally coupled to the second cold head;

a connection refrigerant pipe connecting the first refrigerant cooling unit to the second refrigerant cooling unit; and a connection mechanism detachably provided on the connection refrigerant pipe.

10. The GM cryocooler according to claim 9, further comprising:

a working gas circuit connected to the first cold head and the second cold head such as to generate a pressure differential between the first gas chamber and the second gas chamber.

11. The GM cryocooler according to claim 9, further comprising:

a first connection rod and a second connection rod longitudinal-axially connected to each other; wherein the first displacer is connected to the second displacer via the first connection rod and the second connection rod such that axial reciprocation of the first displacer is of phase inverse from that of axial reciprocation of the second displacer, and the first connection rod is of first cross-sectional area in a plane perpendicular to the first connection rod's longitudinal axis, the second connection rod is of second cross-sectional area in a plane perpendicular to the second connection rod's longitudinal axis, and the first cross-sectional area and the second cross-sectional area are equal.

12. The GM cryocooler according to claim 9, further comprising:

a first connection rod and a second connection rod longitudinal-axially connected to each other; wherein the first displacer is connected to the second displacer via the first connection rod and the second connection rod such that axial reciprocation of the first displacer is of phase inverse from that of axial reciprocation of the second displacer, and the first connection rod is of first cross-sectional area in a plane perpendicular to the first connection rod's longitudinal axis, the second connection rod is of second cross-sectional area in a plane perpendicular to the second connection rod's longitudinal axis, and the first cross-sectional area and the second cross-sectional area differ.

* * * * *